United States Patent [19]

Keith

[11] 4,445,408

[45] May 1, 1984

[54] METHOD AND APPARATUS FOR CUTTING CONTINUOUS FIBROUS MATERIAL

[76] Inventor: Garland B. Keith, 4822 Memorial Blvd., Kingsport, Tenn. 37664

[21] Appl. No.: 78,195

[22] Filed: Sep. 24, 1979

[51] Int. Cl.[3] ..... D01G 1/04

[52] U.S. Cl. ..... 83/37; 83/98; 83/323; 83/343; 83/913

[58] Field of Search ..... 83/403, 402, 913, 343, 83/340, 174, 323, 37, 98, 346, 356.3, 434, 435.2, 331; 241/251, 253

[56] References Cited

U.S. PATENT DOCUMENTS

| | | | |
|---|---|---|---|
| 1,510,729 | 10/1924 | Weisner | 83/340 X |
| 2,214,707 | 9/1940 | Markley | 241/251 |
| 2,221,022 | 11/1940 | Ellis | 83/174 |
| 2,278,662 | 4/1942 | Lodge | 83/403 |
| 2,305,312 | 12/1942 | Kern | 83/174 |
| 2,391,719 | 12/1945 | Llewellyn | 83/356.3 |
| 2,642,135 | 6/1953 | Regalia | 83/323 |
| 2,745,491 | 5/1956 | Sonneborn et al. | 83/403 X |
| 3,111,875 | 11/1963 | Takehara | 83/174 |
| 3,238,828 | 3/1966 | McNutt | 83/174 |
| 3,451,630 | 6/1969 | Pav | 241/251 X |
| 3,566,734 | 3/1971 | Robinson | 83/346 X |
| 3,978,751 | 9/1976 | Farmer et al. | 83/913 X |
| 4,188,845 | 2/1980 | Stukenberg | 83/356.3 X |

FOREIGN PATENT DOCUMENTS

| | | |
|---|---|---|
| 674207 | 4/1939 | Fed. Rep. of Germany . |
| 1433162 | 2/1966 | France . |

*Primary Examiner*—Frank T. Yost

*Attorney, Agent, or Firm*—Burns, Doane, Swecker & Mathis

[57] ABSTRACT

A method and apparatus for cutting continuous funicular material such as tow bands of fibrous material of glass, synthetics, metal, or staple spun threads of any generic type is disclosed wherein two relatively movable closely spaced members are provided with a plurality of knives affixed to the surface of at least one of the members. The material is fed between the rotors and trapped and cut by the knives in a scissors-like manner. In a preferred embodiment, the members are both rotors mounted concentrically each with a plurality of knives. After cutting, the cut staple is flung outwardly from the rotors by centrifugal force.

37 Claims, 15 Drawing Figures

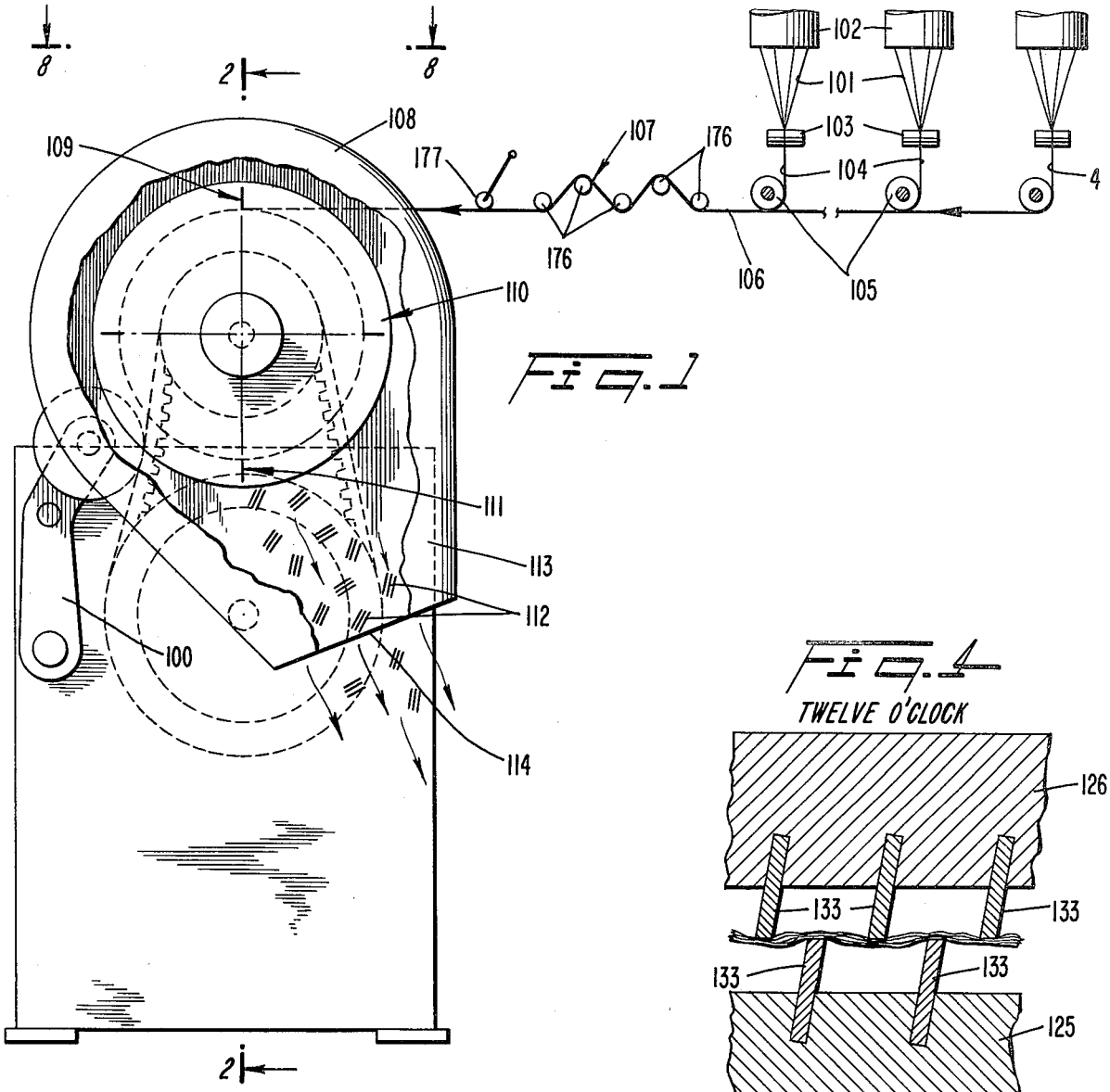
FIG. 1
FIG. 4
TWELVE O'CLOCK
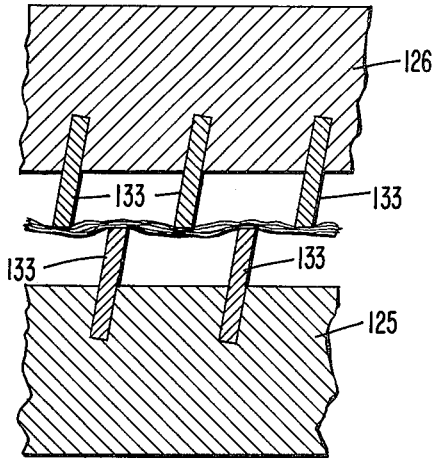
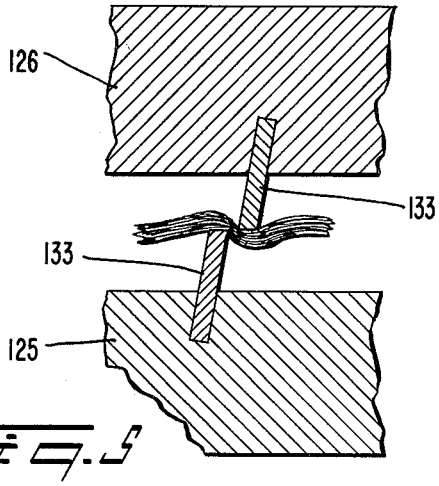
FIG. 5
NINE O'CLOCK
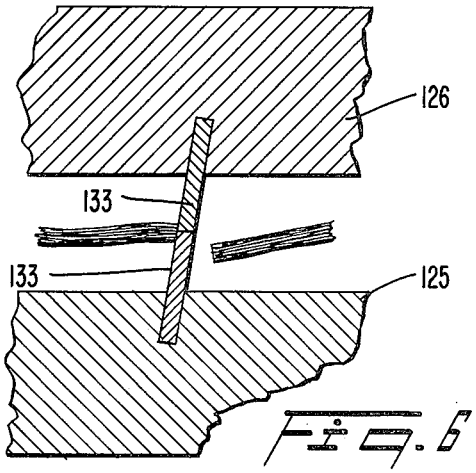
FIG. 6
SIX O'CLOCK Fig. 7
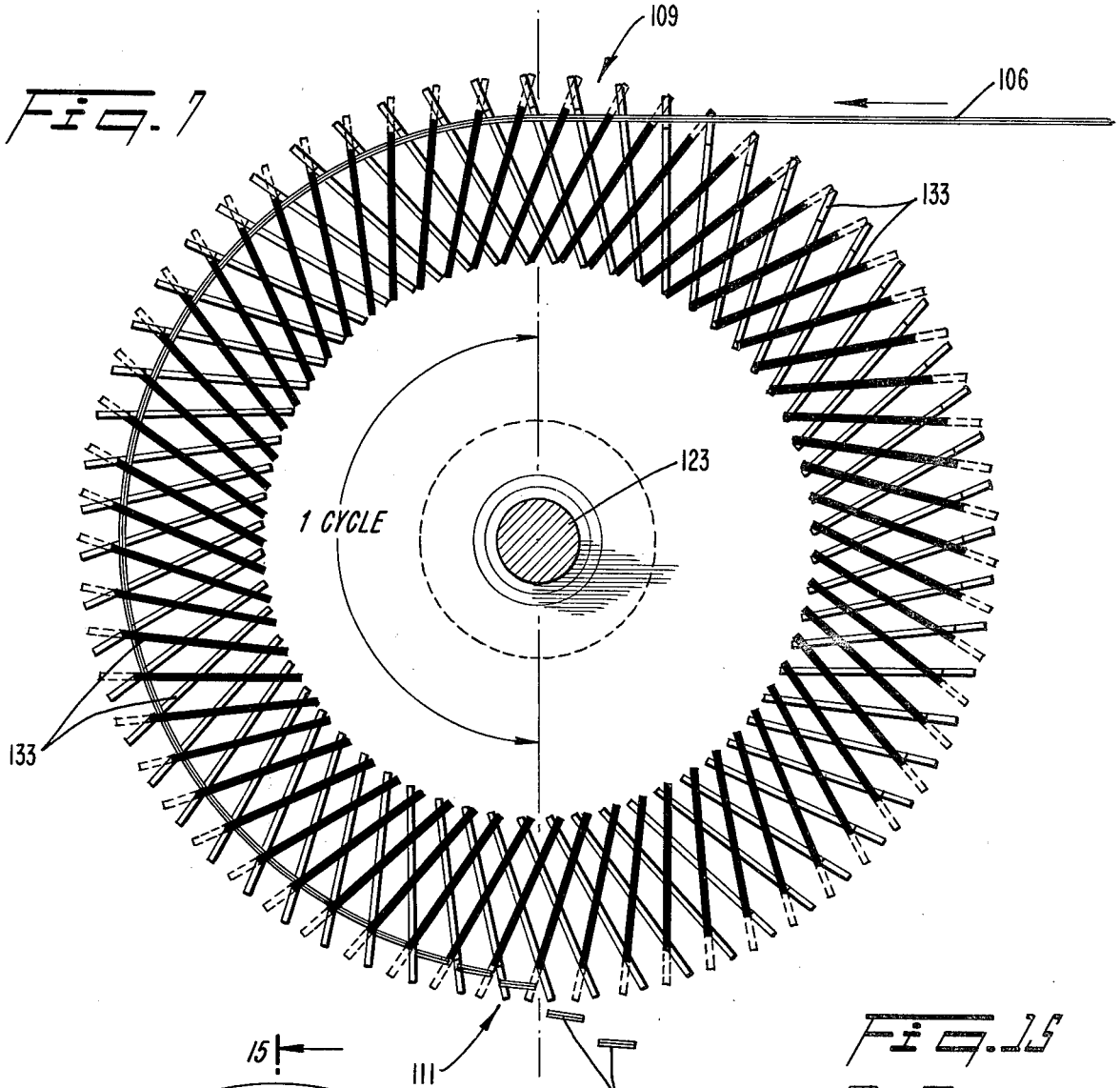
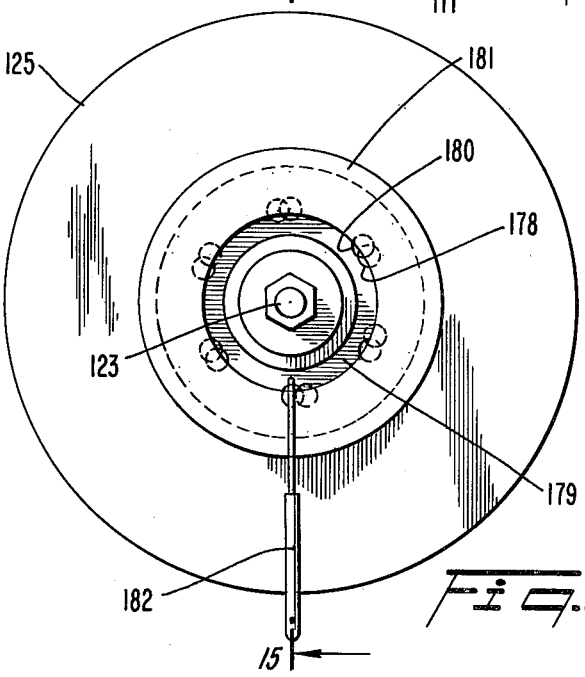
Fig. 14
Fig. 15
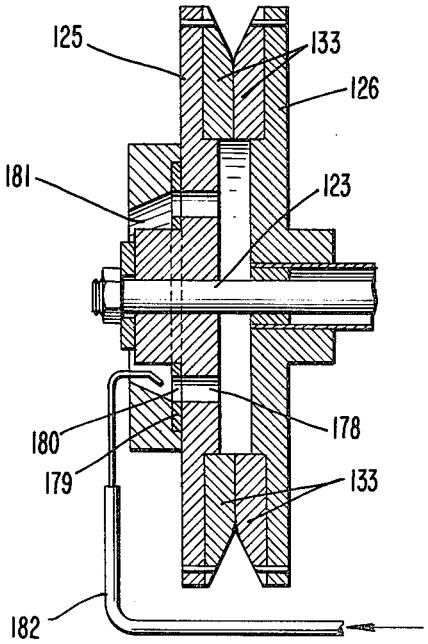

METHOD AND APPARATUS FOR CUTTING CONTINUOUS FIBROUS MATERIAL

BACKGROUND AND SUMMARY OF THE PRESENT INVENTION

The present invention relates generally to a method and apparatus for cutting funicular material such as tow and monofilaments into short lengths.

Problems of cutting filamentary linear materials at high rates of feed are well known in the art. Glass fibers, carbon fibers and metallic fibers, in particular, as well as all of the higher modulus synthetics are troublesome to cut into accurate, usable staple.

Knives travelling at high speed striking an elastomeric surface, bedplate or other knives create turbulence, impact noise, and vibration which produce a highly objectionable environment around cutting equipment. Also, high speed impact results in fiber fusing and generally poor performance. Additionally, knives are usually made of hardened materials which are subject to fracture and present a safety hazard to both fiber manufacturing and fiber usage personnel. In this way, a fractured knife could possibly damage fiber processing machinery. Fractured knives cause multiple lengths of stable, poor fiber performance and machine down time.

Heretofore, the known cutting machines have not been capable of handling very high rates of feed while incorporating a slow cut, nonfusing, flying shear action. The glass fiber and hot melt fiber industries have been hamstrung by the lack of such equipment and have been forced at attenuate or stretch the semi-molten fibers at quite low rates of feed or alternatively, to employ separate heating steps. A cutting machine capable of at least 20,000 feet per minute would make intermediate energy wasting fiber processing steps unnecessary. The hot melt fibers could then go from a reactor to cut staple in one step and the glass fibers, attenuated by the cutter itself, could be run at the maximum speeds permitted by the spinning equipment. In this case, the cutter would no longer be the production bottleneck, and development could begin anew on increasing the spinning speeds.

An example of a prior art cutting device is disclosed in U.S. Pat. No. 3,485,120 issued on Dec. 23, 1969, to Keith. The Keith patent discloses a cutter which has a rotating cutting reel containing knives and a rotating pressure applicator. The material is built up around the cutting reel to be forced by the pressure applicator against the knives and cut into sections equal to the distance between the knives.

Another prior art cutting device is disclosed in U.S. Pat. No. 2,791,274, issued on May 7, 1957, to Rivers, Jr. The Rivers, Jr. patent discloses a rotating roll consisting of two pieces between which the fiber to be cut is trapped and rotated therewith until reciprocating knives in one piece and moved to cut the trapped fiber.

U.S. Pat. No. 3,978,751, issued on Sept. 7, 1976, to Farmer et al discloses (in FIG. 16) a center feed to a rotating camming assembly and a rotating driving disc containing a plurality of knives. The disclosure teaches rotating the driving disc and knives faster than the camming assembly. Cutting occurs when the tow band is peripherally clamped between a belt, or cam, and the knives.

Other U.S. patents which illustrate the state of the art in staple cutting include U.S. Pat. Nos. 4,014,231; 3,861,257; 3,869,268; 3,948,127; 3,557,648; 3,815,461; and 3,768,355.

Present glass fiber cutting equipment takes into account the rapid dulling of the knives and the necessity for short runs and excessive down time. The industry is in great need of equipment which will increase runs from hours to days or even weeks. Also, present metal fiber cutting equipment does not "cut" at all, but instead pulls the fibers in two. Short cut wire and monofilament staple are usually cut on slow punch press cutters. These procedures result in a random staple length having poor end conditions.

Accordingly, it is a primary object of the present invention to provide a method and apparatus which cuts funicular material at a rapid rate into segments having a uniform length.

Specifically, an object of the present invention is to reduce the high impact at the cut point and thereby reduce the possibility of knife breakage and also reduce vibration and noise.

A further object of the present invention is to provide a cutter which will not fuse the fibers together due to heat buildup at very high rates of feed.

A still further object of the present invention is to provide a cutter which will produce uniform and highly accurate cut lengths.

Another object of the present invention is to produce a cutter which sharpens the knives as the cutter is in operation. This self-sharpening feature has the advantages of reducing maintenance and increasing running time for the apparatus.

These and other objects are realized by the apparatus according to the present invention wherein a cutter comprises two closely spaced members, preferably rotors or discs facing one another. At least one of the rotors has a plurality of knives attached to its surface in a pinwheel configuration. In a preferred embodiment, both rotors have knives affixed to their respective surfaces in sliding contact engagement. One of the rotors preferably has at least one less knife than the other rotor. The rotor with the lesser number of knives rotates slightly faster than the other rotor. Attenuation (as in the production of glass or drawn fibers) or tension on the tow band (in the production of other fibers) is accomplished by weaving the tow band zigzag fashion into the spaces formed by the tapered knives on the two relatively sliding pinwheels. In this way, tow band pulling tension begins at the point of entry into the pinwheel niche proper and the tow band can slide down between the knives.

The tow tension builds as each set of knives comes nearer to a configuration of cutting mesh. Actually, the first set of knives (at tow band entry) is in maximum mis-mesh while the intermediate sets of knives are in varying degrees of mis-mesh, and the last set of knives to touch the tow is in complete cutting mesh. Cutting then occurs and the cut bundle, urged by centrifugal force and air (or other suitable medium), escapes from the machine and is flung into a product collector chute.

The present invention is capable of cutting substantially all fibers, but is especially adapted to glass, carbon, metallic and other fibers including wire and different generic monofilaments that, for one reason or another, have heretofore been considered exceedingly difficult to cut. The principle of conventional scissors has been employed at the point of severance of the present invention in a novel manner. The scissors action provides a certainty of cut and also a built-in self-sharpening feature for the apparatus that insures that many additional hours of satisfactory operation can be expected before normal sharpening of the knives by grinding is necessary. In the present invention, the knives grind themselves much like a butcher sharpens his knife.

BRIEF DESCRIPTION OF THE DRAWINGS

Preferred embodiments of a cutter according to the present invention will be described with reference to the accompanying drawings wherein like members bear like reference numerals and wherein:

FIG. 1 is a schematic front elevational view of a cutter according to the present invention showing the cutter in conjunction with the feed and other ancillary fiber manufacturing and handling equipment;

FIGS. 4, 5 and 6 are sections taken along Lines 4—4, 5—5, and 6—6 of FIG. 3 respectively showing, in expanded detail, a flat pattern layout of the proximity of knives from full mis-mesh to full mesh through a half turn of the rotor head;

FIG. 7 is an enlarged section similar to FIG. 3, but of a pair of rotors having more knives and showing the cooperation between the knives on each rotor;

FIG. 14 is an end view of another embodiment of the present invention; and

FIG. 15 is a view through line 15—15 of FIG. 14.

DETAILED DESCRIPTION OF THE PREFERRED EMBODIMENTS

Figure 2:
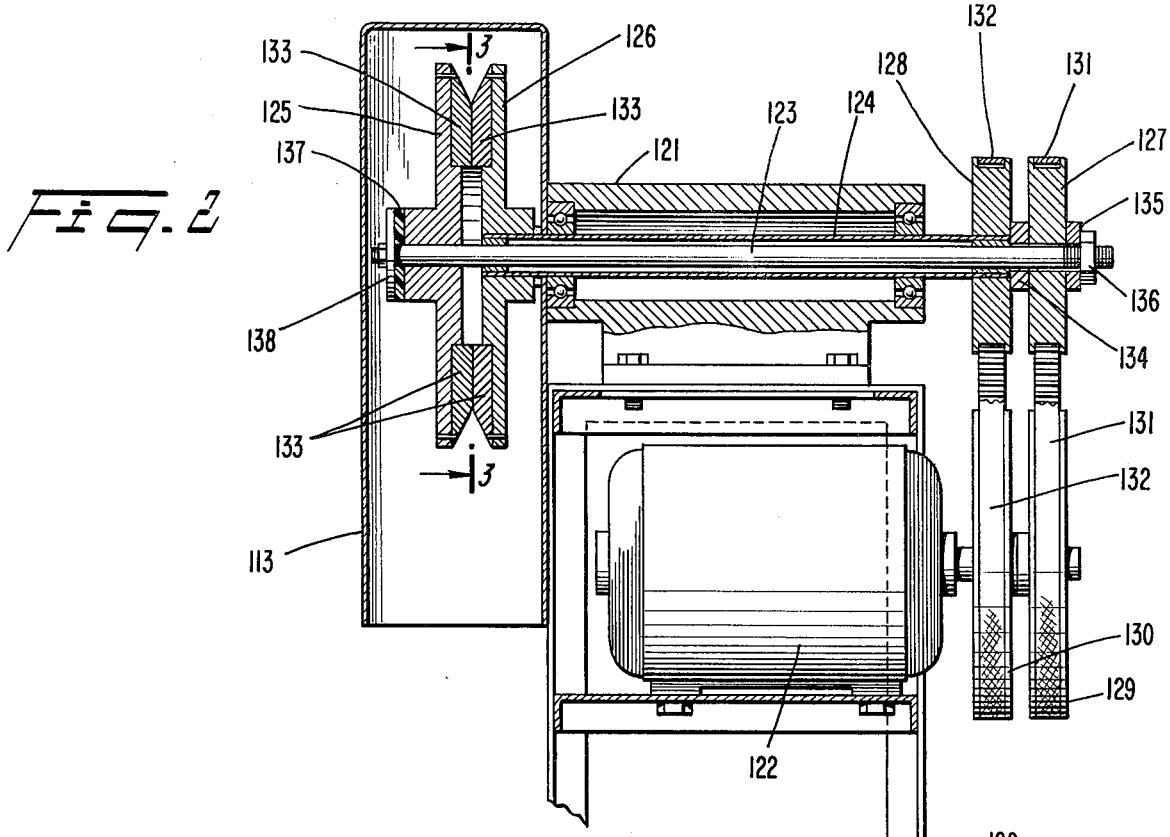
FIG. 2 is a sectional elevational view looking downstream of the fiber feed taken along Line 2—2 of FIG. 1.

Although the present invention may be used to cut a wide variety of filamentary and funicular materials, the preferred embodiments will be described with reference to a cutting of a representative multi-filamentary material.

With reference now to FIG. 1, a multiplicity of filaments 101 issue from each of a series of forming spinnerettes 102 and pass over a finish applicator 103. The filaments gather together into a multiplicity of tow bands 104, and each partially encircles a respective feed roll 105. Each tow band 104 establishes a linear speed and gathers into a larger tow band 106 comprised of the several tow bands 104 (formed in a similar way), which larger tow band 106 proceeds thence through a conventional tensioning mechanism 107. The tow band 106 is fed into a cutter 108 at the topmost or twelve o'clock position 109 and is gripped by and moves with a rotor head 110 for approximately 180°, or just before the six o'clock position 111 (see also FIG. 7). Just before the six o'clock position 111, the tow band 106 is cut into staple 112 of a predetermined length which is discharged into a housing 113 and exits therefrom by way of a chute 114 to be carried away by an air conveyor (airveyor) tube, a belt conveyor, or other apparatus (not shown).

The conventional tensioning mechanism 107 is preferably arranged between the point of entry into the rotors 110 and the feed rolls 105. In this way, by passing the tow snake-like over and under a plurality of fixed rolls 176 with a movable final roll 177, the tension on the tow being fed into the cutting mechanism may be varied. Depending upon the variation in tension of the tow as a result of the forming and/or feeding operation, a tensioning mechanism may or may not be necessary.

It is to be understood that, although the forming spinnerettes 102 are shown delivering fiber vertically and the collected tow band 106 is fed to the cutter 108 in a horizontal attitude, both the feed rolls 105 and the tensioning mechanism 107 may be eliminated and the tow bands may be fed to the cutter 108 in any desired attitude.

Because of fly buildup on guides, particularly at very high speeds during the attenuation of glass fibers, it may be necessary to deliver the filaments vertically from the plurality of forming spinnerettes 102 barely touching or "kissing" the finish applicators 103 and then entering the cutter vertically at approximately the three o'clock position, with cutting of the staple 112 occuring at approximately the nine o'clock position. In this manner of feed, the filaments would touch only the finish applicators 103 between the forming spinnerettes 102 and the cutter 108. Alternatively, a spray could be employed to apply the finish and leave the tow band untouched from spinning to cutting, thereby eliminating any guides where fly buildup would occur. One of the functions of the feed rolls 105, in prior processing hardware has been to establish a feed or tow speed. Such establishment of a feed speed is not necessary in the present invention because of the ability of the rotors to grip and tension the tow during cutting as explained subsequently.

A preferred embodiment of the cutter 108 is more readily understood with reference to FIG. 2 wherein a frame 120 supports a double pillow block 121 and a drive motor 122. The double pillow block 121 receives an inner shaft 123 and an outer sleeve 124. The inner shaft 123 has an outboard rotor 125 at one end and an outer timing sheave 127 at the other end. The outer sleeve 124 has an inboard rotor 126 mounted at one end and an inner timing sheave 128 at the other end.

The outer timing sheave 127 and the inner timing sheave 128 are driven by the drive motor 122 through respective drive sheaves 129 and 130 and drive belts 131 and 132. If necessary, a belt tensioning device 100 may be provided (see FIG. 1). A plurality of knives 133 of a suitable material are fixed to the inner rotor 126 and likewise a plurality of knives 133 are fixed to the outer rotor 125 in a quantity which is sufficient to divide the rotor cutting circle into a suitable number of spaces with the spaces defining the desired length of cut. The knives could be arranged with random or equal spacing depending upon the type of material and the length of cut desired. An external hub plate 138 is secured to the inner shaft 123 and applies adjustable pressure to the rotor 125 through a resilient pressure washer 137.

The external hub plate 138 is also rotatably fixed both to the rotor 125 and to the inner shaft 123. The pressure washer 137 is loaded against the rotor 125 by a thrust bearing 134 (provided between the sheaves 127, 128), a thrust collar 135 and an adjustable locknut 136. By tightening and setting the adjustable locknut 136, it is possible to achieve any reasonable degree of "fit-up" pressure desired on the knife gap near the line 3—3 in FIG. 2. Hence, any magnitude of pressure on the many knife edges is possible depending upon the cutting pressure required for the particular type of fiber being cut.

It is preferable, of course, to minimize the weight of the rotors and the parts attached thereto so as to decrease the tendency of the rotors to oscillate unduly from kinetic energy of rotation. It is preferable, however, to maintain an adequate angular momentum so as to avoid a "slip-stick" condition common to low rotational speeds of the apparatus. In this way, it has been found advantageous to confine the "fit-up" resiliency of the assembly to only one member with a resilient mounting of the knives in only one rotor adjudged to be suitable for practical balancing purposes.

Resilient mounting within one of the rotors 125, 126 is also desirable in order to prevent damage to the knives. Various elastomeric arrangements, for example, may be utilized to permit a slight axial movement of the knives of one rotor. To suitably fix the knives in each rotor, it has been found to be preferable to provide a respective slot 190 (see FIG. 9) for each knife with a press fit pin 191 provided in a bore 192 extending through the knife and the rotor. The end of the press fit pin is preferably ground flush after assembly.

Air holes 178 (see FIGS. 14 and 15) may be provided near the shaft 123 at the center of either rotor to permit the rotor unit to become a centrifugal fan. These air holes would aid the centrifugal force acting on the cut fiber and tend to blow or fling the cut fiber away from the rotors and toward the chute 114. The air holes could also be provided with forced air from an external source (not shown) to further enhance the effect. If desired, a cover plate 179 having holes 180 corresponding to the holes 178 can be rotatably mounted with respect to the one rotor so as to permit a control or damping of the amount of air supplied through the air holes 178.

According to a further feature of the present invention, sizing or finish can be controllably introduced into the air (drawn or forced) through the air holes. With reference again to FIGS. 14 and 15, a channel 181 may be provided about the holes 180 on the cover plate 179. A suitable conduit 182 would supply a metered amount of sizing or finish to the channel with the sizing or finish then supplied to the rotors through the air holes 178. The sizing or finish would enhance the performance of the cut staple for its particular end use and would also aid in lubricating the sliding plurality of knives affixed to the rotors.

It is preferred that one of the rotors has one or more additional knives than the other rotor. If the rotors each had the same number of knives arranged in an equally spaced relationship on each of the rotors, at a certain point during the co-rotation of the rotors the outermost end of the knives on one rotor would coincide with the outermost end of the knives on the other rotor. At this time, there would be no opening into which the fiber to be cut could be fed. It is also preferred that the rotors be timed by the drive sheaves 129 and 130, the drive belts 131 and 132, and the timing sheaves 127 and 128 or by other suitable apparatus such as gearing, so that the rotor with the lesser number of knives rotates faster than the rotor with the greater number of knives. The difference in speed is preferably such that the same number of knives on each rotor pass by a given point near the periphery of the co-rotating rotors in a given period of time. Both rotors are turning in the same direction and therefore the rotor with the lesser number of knives is constantly overtaking the rotor with the greater number of knives in a timed ratio. In this way, the individual knives of one rotor may be said to be advancing with respect to the knives of the other rotor (preferably one knife per revolution of the rotor).

Figure 3:
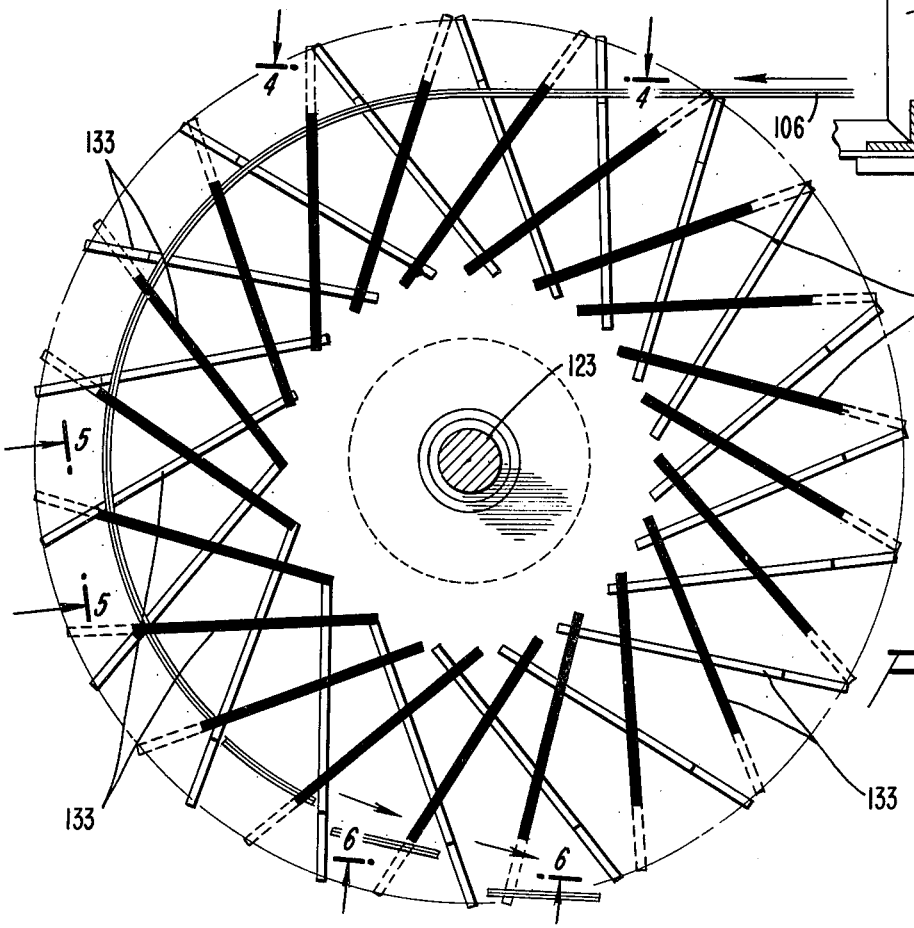
FIG. 3 is a sectional view taken along Line 3—3 of FIG. 2 near a plane of sliding contact of the knives.

The plurality of knives 133 on each rotor, shown in FIG. 3, are slanted so they do not point to the rotor center and are therefore not true spokes. In this way, each of the knives is preferably arranged so that it forms an angle of other than 90° with a tangent line at the periphery of the rotor.

The knives 133 together form a pinwheel configuration on the surface of the rotor and present a maze of crossing points. In this way, the knives of each rotor are arranged in divergent directions with respect to the adjacent knives of the other rotor so as to form the scissors-like arrangement. This is true because the knives on one rotor are slanted in a direction opposite to those on the other rotor when assembled with their respective knives facing each other. If each rotor is viewed separately, however, looking toward the surface with the knives, the knives are preferably oriented in the same direction except that one of rotors contains at least one more knife than the other rotor.

The surfaces of all of the knives of each rotor are preferably ground in a flat plane. The slant causes any one knife on the rotor 125 to cross three knives on the rotor 126, in the illustrated embodiment of FIG. 7. Whether the knives of one rotor cross one, two, three or more knives of the other rotor depends upon the configuration (i.e. spacing, angle of orientation, thickness, etc.) of the knives of the rotors. Therefore it can be seen that with sixty knives on one rotor providing a three quarter inch cut, (see FIG. 7) the embodiment has a maze of one hundred and eighty touch points constantly sliding along the edges of the many knives to sharpen them. This sharpening action continues even while the edges of the knives are cutting fiber, because the sharpening action does not disturb the cutting edge proper. When a finish is applied to the fiber immediately prior to cutting, the finish may be designed to act as a cutting oil further enhancing the sharpening action.

Figure 8:
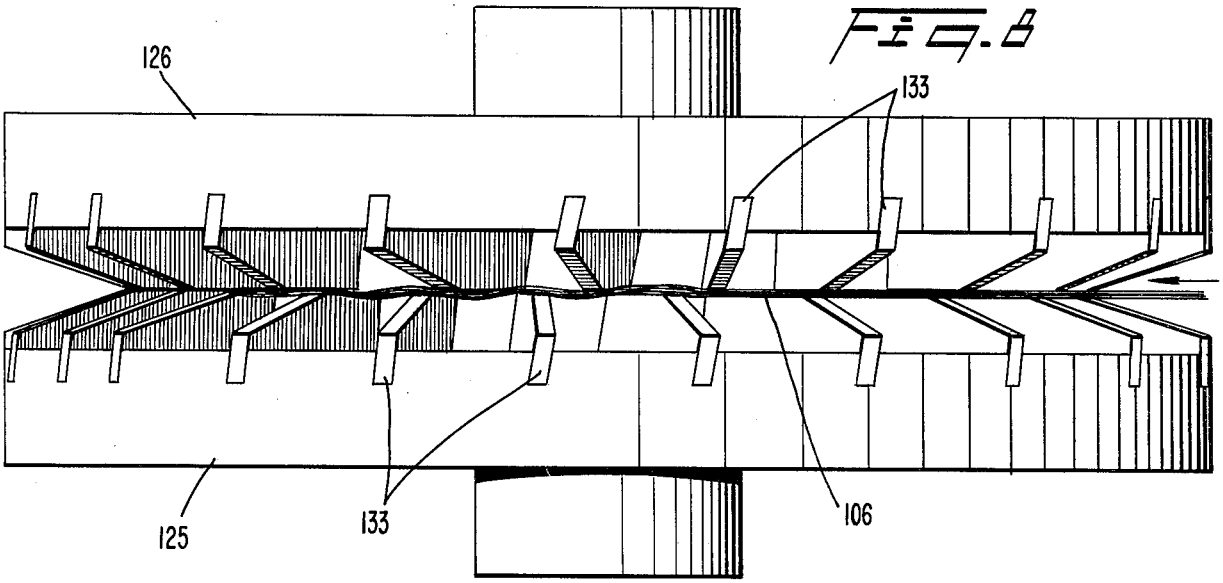
FIG. 8 is a pictorial view along the line 8—8 of FIG. 1.

With reference now to FIG. 8, the tow band is woven snake-like between the out-of-mesh knives at the twelve o'clock position. The tension of the mechanism 107 (see FIG. 1) along with the gripping of the tow band by the adjacent knives of the rotors at about the nine o'clock position, causes the tow band to be pulled down between the out-of-mesh knives. As the tow progresses around the periphery of the rotors, the knives come into closer mesh with one another until the tow is finally cut and free to be thrown off radially.

The progressive meshing of the knives 133 on the outer rotor 125 and the inner rotor 126 is better understood with reference to FIGS. 4, 5 and 6. As stated previously, the rotors have a different number of knives, one rotor preferably having one less knife than the other and rotating at a faster rate of linear speed so as to have every knife mesh in each revolution as every knife of the faster rotor advances with respect to an adjacent knife of the slower rotor during each revolution. In FIG. 4, the knives are seen in a maximum out-of-mesh position. This point is identified as the "twelve o'clock" position (with reference to FIG. 1) and is the point where the fiber is fed into the cutter. In this position, the fiber can be pulled down between the knives serpentine-like by the tension on the tow band.

In FIG. 5, labeled the "nine o'clock" position, the knives are shown approaching mesh. The fiber bundle is being squeezed and the magnitude of pull which can be exerted on the tow bundle by the several sets of semi-meshing knives is more fully understood. In FIG. 6, labeled the "six o'clock" position, the knives are in full mesh, the faster rotor with the fewer knives having overtaken the slower rotor with more knives. Obviously the tow band, previously having zigzagged snake-like to avoid being severed, has now passed the point where the two knives have meshed firmly in a scissors-like manner and has been severed into staple of a length equivalent to the spacing between the generally spoke-like knives. Note that increasing the tow tension will force the tow band toward the hub, resulting in a slightly shorter staple and slower feed, while slackening on the tow tension will permit it to range outward along the rotors where the knives are spaced further apart resulting in a slightly longer staple and a faster feed. The orientation of the knives, coupled with a variation of the feed-on point, e.g. one or two o'clock instead of twelve o'clock, and a setting of the rotor speed will result in exact control over both tow band tension and staple length. The knives 133, in different stages of mesh in motion on the rotors 125, 126 are utilized to establish a feed or tow speed thereby eliminating the need for one of the functions of the feed rolls 105.

Figure 10:
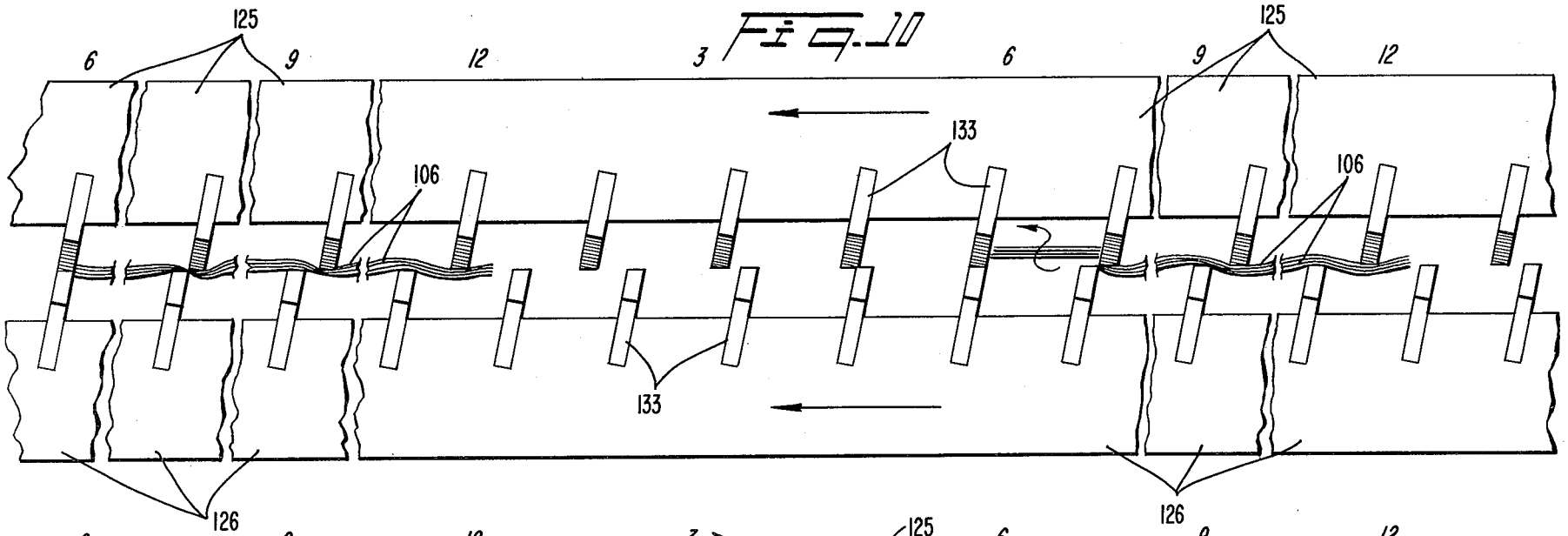
FIG. 10 is a panoramic view directed radially inwardly of the rotors of FIG. 1.

The advancement of a knife of one rotor with respect to a knife of the other rotor may be seen more readily with reference to the panoramic view of FIG. 10. As shown, at the twelve o'clock position the knives are in maximum mis-mesh. Moving from right to left in the drawing (at a radial position just beyond the tow band 106) the knives are seen to come progressively into cutting engagement with one another until maximum mesh is achieved at the six o'clock position. At this point, the already cut tow band is flung radially outwardly. Moving further to the left (about the rotors) the knives progressively again assume the maximum mis-mesh position at twelve o'clock.

The view of FIG. 10 can also be considered as illustrating the progressive movement of a single knife of one rotor toward and then beyond an adjacent knife of the other rotor. In this way, the one knife may be seen to advance with respect to the other knife of the other rotor during the relative rotation of the rotors. The view of FIG. 10 can be considered to show the relative movement of individual knives of the rotors with respect to one another much as a properly adjusted strobe light and camera arrangement would show the relative positions of the knives moving relative to one another about the rotors during rotation.

Figure 11:
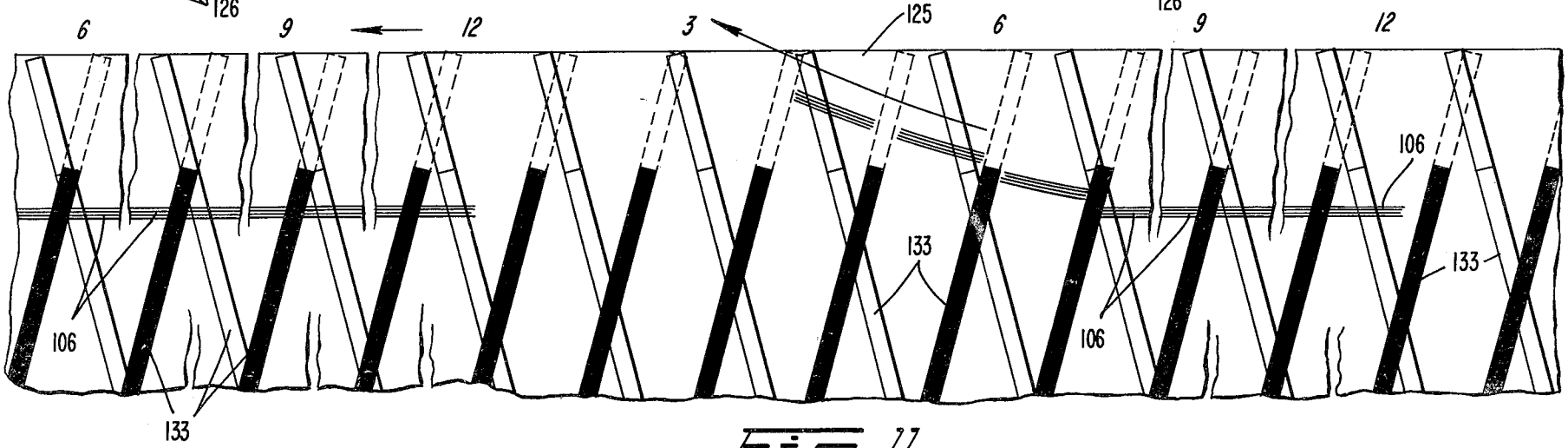
FIG. 11 is a cross sectional view of the rotors of FIG. 1 arranged as a linear progression.

With reference to FIG. 11, the relative movement of the knives of one rotor with respect to the knives of the other rotor is illustrated in a manner similar to that of FIG. 10 but with an axial view rather than a radial view. In FIG. 11, the curved periphery of the rotors has been illustrated in a linear view. Moving from right to left, the outer ends of the knives are directed upwardly and slant away from one another to provide the "V" groove entrance (see also FIG. 8). At the twelve o'clock position, the radially outermost flat portions of the knives of the rotors are in maximum mis-mesh. Progressing to the six o'clock position, the radially outermost flat portions of the knives first engage one another to prevent the tow band from escaping between the knives and subsequently cut the tow band (at least by the six o'clock position). The cut tow band segments are then free to fly radially outwardly from the rotors.

Referring to the embodiment of FIG. 3, the scissors-like cutting of the tow is understood to proceed continuously as the two rotors mesh. FIG. 3 is taken along the section 3—3 in FIG. 2 which cuts through one set of knives looking into the other set. The angles of the knives and their scissors-like shear arrangement become clear when this assembly is analyzed especially with reference to FIGS. 10 and 11. It will be noted that neither set of knives is arranged so that the knives will pass through the center or hub of the rotor. Therefore, they are not true spokes.

Instead, the knives of each rotor are tangential with respect to an imaginary circle concentric about the axis of the rotor with the radius of the imaginary circle depending upon the angle of inclination of the knives. The angles have been designed to give the two sets of knives a scissors-like shearing effect at their ideal cutting point. Development work, in an attempt to determine the optimum parameters for general use, points to knives set at an angle of 15° to a radial line, making a total scissor angle of 30° between the two knives at peripheral contact. It is to be understood that this angle will vary gradually as the rotors turn. Furthermore, knives set in the rotor at 10° to the planar surface and sharpened with a 10° rake angle also appear near the optimum for general use.

Figure 9:
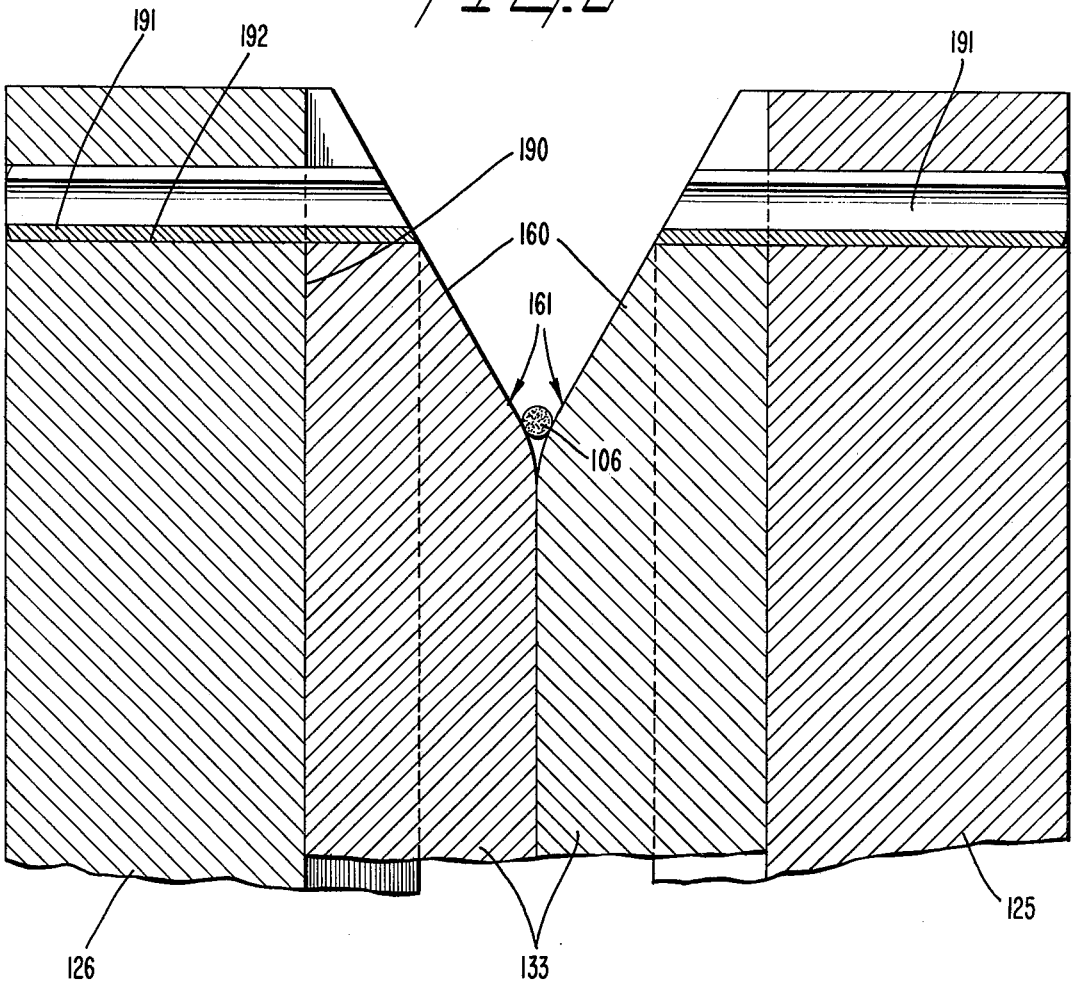
FIG. 9 is an enlarged side view of a pair of knives.

The shape of the rotors and the knives preferably cooperate with one another to form a "V" groove as best seen in FIG. 9. Each of the knives 133 is preferably provided with an angularly sloping section 160 at the outer end of the knife. These sections 160 slope toward the periphery of the rotors 125, 126 to form a substantially "V" shaped groove having an angular dimension of, for example, about sixty degrees and more preferably about thirty degrees. At the base of the "V" the knives 133 have a radius section or knee 161 which forms an obliquely curved bottom to the "V". The angular slopes 160 and the radii 161 on the knives are designed especially to cooperate to collect any straying filaments and direct them into the rounded crevice of the "V" groove in zigzag fashion where the filaments are urged further between the sets of rotating knives ready for severing.

Figure 12:
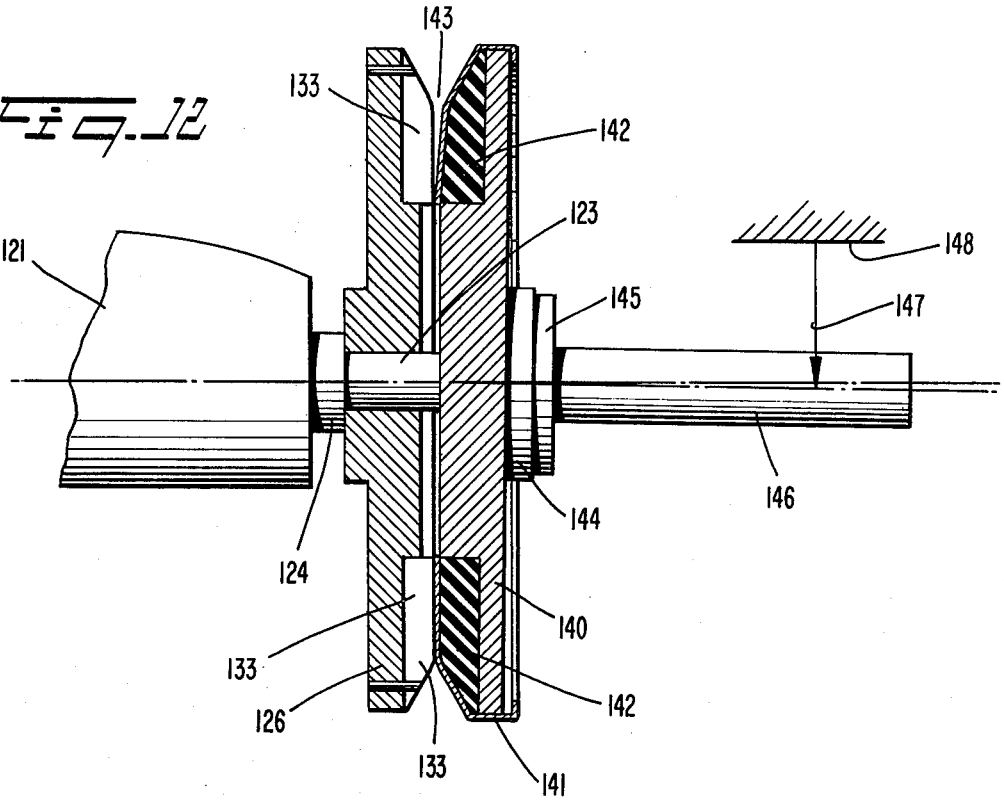
FIG. 12 is a pictorial view of a second embodiment of the present invention wherein one rotor is tiltable and has a smooth surface, while the opposed rotor has a plurality of knives.

Referring to FIG. 12, a second embodiment of a cutter according to the present invention is illustrated. In this embodiment only a single rotor 126 contains a plurality of knives 133 which mesh with a suitable wear-resistant surface 141, on a rotor 140. The surface 141 is pressed against the knives 133 of the companion rotor 126 by a resilient device 142 to insure contact in the cutting zone. The rotor 126 is mounted, as in the previous arrangement, on a sleeve 124 which carries a shaft 123 that mounts a rotor 140. A thrust bearing 144 is aligned by a hub 145 mounted on a wobble shaft 146. The wobble shaft 146 is actuated by a force (the arrow 147) from an external stationary source 148 to provide suitable cutting pressure between the knives 133 and the wear resistant surface 141. The wobble shaft 146 also provides an opening niche 143 into which the tow band can enter.

The embodiment of FIG. 12 is especially adapted to cut glass fiber or materials which fracture or readily scuff apart. The timing of the rotors would not be as critical in this embodiment since the knives would set down on the fiber, grip it firmly, and then scrape along the companion rotor surface under pressure until the tow band has severed. The knives on such a modification would obviously be very hard and the companion rotor surface would be a hardened metal or other suitable material as well. The wear surface would be expected to erode and would therefore be expendable. Also, the knives would require sharpening occasionally.

Figure 13:
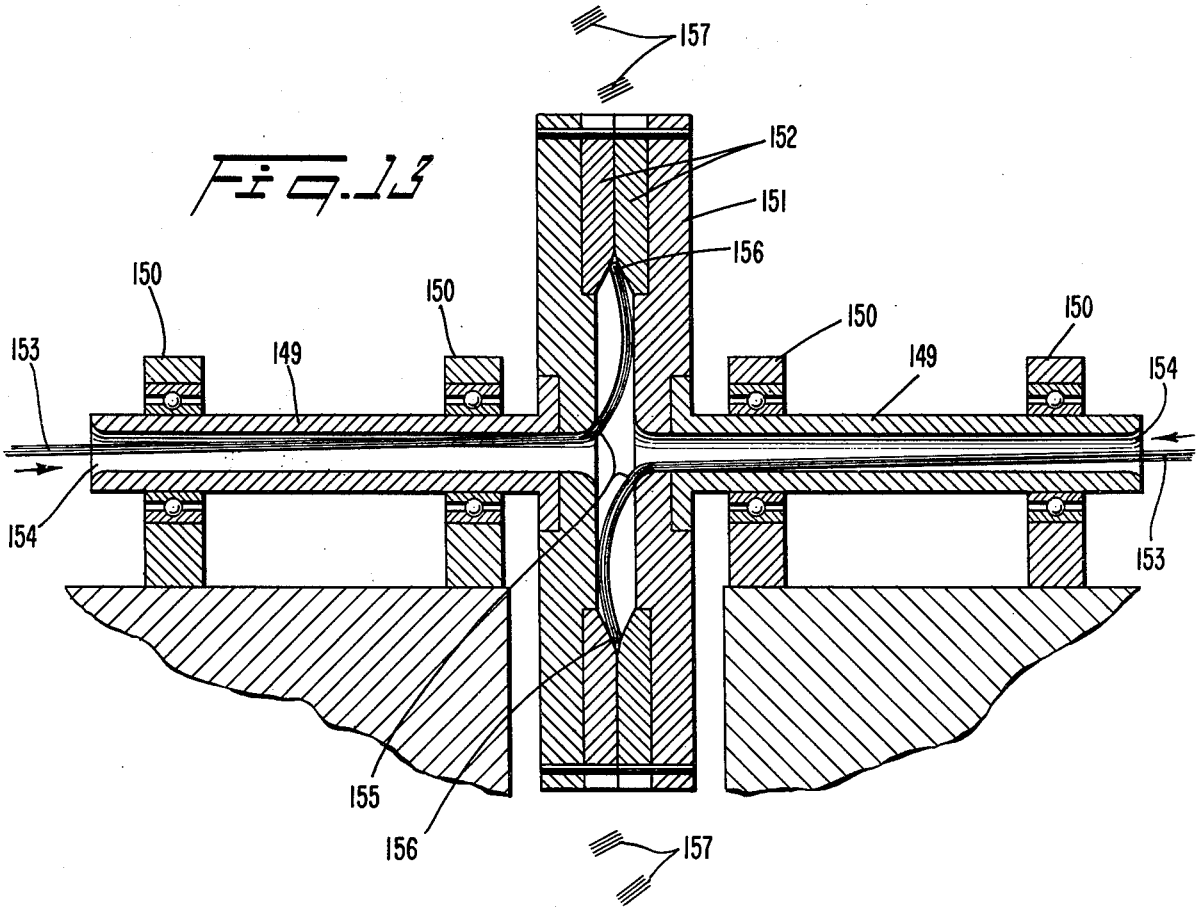
FIG. 13 is a cross sectional view of a further embodiment of the invention showing a cutting apparatus with the feed entering the center of the rotors through hollow shafts as multiple tows and exiting as cut staple at the periphery of the rotors.

The previous embodiments show cutting units which accept the tow band from outside the periphery of the rotors, grip it, cut it and discharge it again toward the outside. FIG. 13 illustrates a further embodiment of the present invention wherein fibrous tow bands 153 are fed into hollows 154 in aligned mount shafts 149 from opposite ends of a machine, progressing thence to be cut and discharged, as previously explained, on the rotor periphery. This machine can be described as an "inside out" cutter. Referring to FIG. 13, shafts 149, mounted in aligning bearings 150, cooperate with drive rotors 151 which carry embedded knives 152. The rotors 151 are drivably timed, by an apparatus similar to that in FIG. 2, to mesh at least once per revolution. Fibrous tow bands 153 enter through the hollows 154 of the shafts 149 and proceed through right angle turns at 155 to an internal sloping knife channel 156. The tow band lies, by centrifugal force, in a circular band zigzagging between knives 152 until rotation of the rotors 151 and subsequent meshing of the knives 152 cause the tows 153 to be severed. The cut fiber exits at the periphery of the rotors 151 through the spaced knives 152 as cut staple 157 and is carried away by a collector chute (not shown).

Of course, it is possible to provide apparatus according to the present invention having a pair of rotors mounted off axis with respect to one another or with the knives mounted on members other than rotors. It is preferable, however, that the knives be arranged for travel in one or more continuous paths, (for example, on one or more endless belts) so that the knives of the one member are arranged in sliding contact with either a smooth surface or a plurality of knives of the other member. Preferably the two members are moving in the same direction at the point of sliding contact but at slightly different speeds so as to cut the material between the members.

It is preferred that two of the instant machines of FIG. 1 work in tandem with one of the machines acting as a spare. In this manner, a first machine (#1) would be taken out of service for repairs or maintenance while a second machine (#2) is substituted. A simple threadup method is afforded by the machines wherein the new machine is placed upstream of the machine in use (in line with the tow band). The new machine (#2) is turned on and synchronized in feed speed with the operating machine (#1). Now the tow band is pressed gently through the opening in the rotor housing of machine (#2) into the "V" groove niche formed by the rotors and knives where it is grabbed by the action of the knives on the tow band sides. This action takes the tow band from the downstream machine and the cutting process on the new machine begins. The old machine is then removed for repairs. The new machine may be moved on a track or other device to the position of the old machine. The old machine, when repaired, is inserted back into the line to occupy the role of a new machine waiting to be used. In this manner, no spinning line ever need be shut down for cutter repairs.

Upon initial thread-up of the cutter of the present invention, a number of adjustments need to be checked. The output conveyor (belt or air) needs to be adjustable to be used by both machines (e.g., #1 and #2). The length of the output staple needs to be checked and the speed of the cutter set with both the line speed and the tow band tension to procure the exact cut length desired. The knife pressure needs to be determined either by motor line draw versus tow size and tension or by a micrometer adjustment on the knife pressure adjustment locknut 136. An air cylinder or diaphragm provided with a pressure regulator, all equipment well known in the art, can be installed to monitor the knife pressure at all times after it is initially determined. Knife pressures obviously vary with changes in the generic type of fiber being cut, the desired staple length, the tow band size, and the knife material and condition.

The tow band can now be fed into the cutter at linear speeds of 20,000 feet per minute and up. The tow band is clamped by knives crossing over each other along its feed-in path on the rotor circle. The tow band follows this path only shortly, for example, from the topmost or twelve o'clock point to near the bottommost or six o'clock point, until the timed rotors catch the tow in a squeeze between two knives. The tow is then severed and flung outward by centrifugal force. Both rotors are dynamically balanced and are running in the same direction with one rotor running only slightly faster than the other. Of course, the rotors are rotating at particular angular velocities but these angular velocities produce separate linear speeds at the periphery of the rotors depending upon the diameter of the rotors. For example, using fifteen inch diameter rotors at a fiber tow feed rate of 20,000 feet per minute, cutting three quarter inch staple, one rotor may preferably be running at 5093 rpm, the other rotor preferably running at 5178 rpm with the machine making about 320,000 cuts per minute.

In summary, during operation of one preferred embodiment apparatus according to the present invention, a tow band or other funicular material is fed between a first and a second series of knives at a point of mis-mesh of the knives. The two sets of knives are moving in the same general direction with one set preferably moving at a faster linear speed than the other set so that the knives of one set advance with respect to the other set. In this way, the tow band is first grasped between the sets of advancing knives and then cut into individual segments by the sliding relative movement of the knives.

Four valuable advantages may be seen in the present invention. First, the knives are angles in such a manner that they trap the tow band very soon after it is introduced snake-like between the rotors and will not let centrifugal force induce the tow to escape. It is as if the scisssors were outside the rim cutting toward the hub. Accordingly, the tow cannot escape being cut and is trapped and held until cutting occurs.

Second, the arrangement of the knives insures that any knife will always be touching at least two other knives. Hence, there is no fulcrum or seesaw loading or vibration tending to destroy the rotor or its components. In the preferred embodiment, most of the knives will be bearing on three other knives and a fifteen inch rotor cutting three quarter inch staple will provide over three square inches of hardened knife surface constantly in bearing contact.

Third, since the knives do not just touch momentarily, as in the age old knife-bedplate relationship, but slide along the other knives, a filing motion occurs and the knives self sharpen in a manner that is similar to the method a butcher uses to sharpen his knives. Because of the sharpening action the rotors can be run for a period of time required to wear down over one eighth inch depth on all the knives in both rotors. On the aforementioned fifteen inch rotor cutting three quarter inch staple, this would entail the wearing away of over eight cubic inches of hardened metal from a single set of knives. Considering the self-sharpening feature, this could very well mean periods of non-stop running of a year or more.

Fourth, the knife angle and configuration in both rotors is so arranged that at the time the tow band is cut, the knives are spaced apart at their maximum distance thus facilitating the exit of the cut staple from the rotor assembly. Additionally, the centrifugal force has now achieved its maximum, and the output of the cutter can thus be directed toward a given point for discharge, not unlike the pointing of a hose nozzle.

It is to be understood that there are variations in the apparatus or method to accomplish the same results as outlined in the preferred embodiments, the specification and the explanations given above. Some immediate variations which are feasible include gears to time the rotors; a cutter built in a hollow shaft, variable speed motor thus eliminating the separate journal box; solid carbide, carbide tipped, or other exotic hardened knives; a reverse blower system to force cut staple inboard of the rotors and thence outwardly through the hollow shafts; and many others. Furthermore, the knives may be arranged on other than concentrically mounted rotors and may even be arranged for example on endless belts so as to travel in continuous paths with respect to one another being in sliding contact only a portion of the time. Thus it is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. An apparatus for cutting material, comprising:
- a first member having a first surface defined by a first plurality of knives spaced with respect to one another;
- a second member having a second surface in at least partial contact with said surface, one of said first and second surfaces being generally flat;
- means for moving the first member relative to the second member with said first and second surfaces in sliding physical contact with one another at a first region;
- means for feeding a continuous strand of material between the first and second surfaces;
- first means for moving the first member in a first continuous path at a first linear speed; and
- second means for moving the second member in a second continuous path at a second linear speed.

2. An apparatus for cutting material, comprising:
- a first member having a first surface defined by a first plurality of knives spaced with respect to one another;
- a second member having a second surface in at least partial contact with said first surface, one of said first and second surfaces being generally flat;
- means for moving the first member relative to the second member with said first and second surfaces in sliding physical contact with one another at a first region;
- first means for moving the first member in a first continuous path at a first linear speed;
- second means for moving the second member in a second continuous path at a second linear speed;
- said first and second linear speeds being different and said first and second surfaces moving in the same general direction at said first region of sliding contact.

3. An apparatus for cutting funicular material into segments, comprising:
- a first plurality of knives spaced with respect to one another, said first plurality of knives defining a generally flat surface;
- a second plurality of knives spaced with respect to one another, said second plurality of knives defining a generally flat surface arranged adjacent the generally flat surface of said first plurality of knives with at least some of said first plurality of knives being in sliding contact with at least some of second plurality of knives;
- first means for moving said first plurality of knives in a first continuous path at a first linear speed;
- second means for moving said second plurality of knives in a second continuous path at a second linear speed different than said first linear speed with said knives in sliding contact with one another advancing with respect to one another to cut said funicular material.

4. An apparatus for cutting funicular material into segments, comprising:
- a first plurality of knives spaced with respect to one another;
- a second plurality of knives spaced with respect to one another and arranged adjacent said first plurality of knives with at least some of said first plurality of knives being in sliding contact with at least some of said second plurality of knives;
- first means for moving said first plurality of knives in a first continuous path at a first linear speed;
- second means for moving said second plurality of knives in a second continuous path at a second linear speed different than said first linear speed with said knives in sliding contact with one another advancing with respect to one another to cut said funicular material;
- a first rotor, said first plurality of knives being provided on said first rotor;
- a second rotor, said second plurality of knives being provided on said second rotor, said first and second rotors being coaxially mounted with respect to one another.

5. An apparatus for cutting funicular material into lengths of staple comprising:
- a first rotor having a first surface;
- a second rotor having a second surface, said first and second surfaces being in at least partial contact with one another;
- a first plurality of knives defining said first surface of the first rotor and facing said second surface of the second rotor;

a second plurality of knives defining said second surface of the second rotor, the first and the second pluralities of knives each being arranged in a pinwheel configuration with the knives of the first and the second pluralities arranged in divergent directions with respect to one another; and rotating means for rotating the first and second rotors relative to one another.

6. The apparatus of claim 5 wherein each knife of the first plurality of knives is in continuous sliding contact with at least two knives of the second plurality of knives.

7. The apparatus of claim 6 wherein the second plurality of knives defining the second surface includes at least one more knife than the first plurality of knives defining the first surface.

8. The apparatus of claim 5 wherein each knife of the first plurality of knives is in continuous sliding contact with at least three knives of the second plurality of knives.

9. An apparatus for cutting funicular material into lengths of staple comprising:

a first rotor having a first surface defining an axial end of said first rotor;

a second rotor having a second surface defining an axial end of said second rotor with said first and said second surfaces being in at least partial contact with one another with said first and second rotors being mounted generally coaxially with respect to one another;

a first plurality of knives defining said first surface of the first rotor and facing said second surface of the second rotor; and rotating means for rotating the first and second rotors relative to one another.

10. The apparatus of claim 9 wherein the second surface of the second rotor comprises a wear resistant surface.

11. The apparatus of claim 9 further comprising:

a second plurality of knives defining said second surface of the second rotor.

12. The apparatus of claim 11 wherein the second plurality of knives defining the second surface includes at least one more knife than the first plurality of knives defining the first surface.

13. The apparatus of claims 10 or 12 wherein the rotating means includes means for rotating the first rotor faster than the second rotor at a pre-determined ratio.

14. An apparatus as in claim 11 wherein a cutting edge of each of the knives in the first and the second pluralities of knives is provided with a generally flat section which is generally perpendicular to an axis of rotation of the rotor and an angled section sloping towards the perimeter of the respective rotor with a rounded knee connecting the angled section to the flat section.

15. An apparatus as in claim 9 wherein each of the first plurality of knives is resiliently affixed to the first rotor.

16. The apparatus of claim 9 further comprising feeding means for feeding a continuous strand of material between the first and second rotors at a periphery of the rotors.

17. The apparatus of claim 16 wherein the feeding means feeds the continuous strand of material between the rotors at a center of the rotors.

18. An apparatus as in claim 16 wherein the feeding means feeds the continuous strand of material between the rotors at the periphery of the rotors at a point of mis-mesh of the first and second plurality of knives.

19. An apparatus as in claim 9 further comprising means for admitting air to a radially inwardly portion of the first rotor, said air passing outwardly to a perimeter of the first rotor.

20. An apparatus as in claim 19 wherein said means for admitting air includes an air hole provided substantially at the center of the first rotor.

21. The apparatus as in claim 19 further comprising:

a plurality of air holes arranged about the center of the first rotor; and means for controlling the supply of air to said air holes.

22. An apparatus as in claim 21 further comprising:

means for supplying a lubricating fluid to said air holes.

23. An apparatus as in claim 22 wherein the lubricating fluid comprises a sizing for the material to be cut.

24. An apparatus for cutting funicular material into lengths of staple comprising:

a first rotor having a first surface defining an axial end of said first rotor;

a second rotor having a second surface defining an axial end of said second rotor with said first and second surfaces being in at least partial contact with one another with the axes of the first and the second rotors coplanar and axially angled with respect to one another;

a first plurality of knives defining said first surface of the first rotor and facing said second surface of the second rotor; and rotating means for rotating the first and second rotors relative to one another.

25. A method of cutting funicular material into segments, comprising the steps of:

feeding said funicular material between first and second surfaces, each of said surfaces being defined by a plurality of knives with said pluralities of knives being arranged in at least partial sliding contact with one another, said knives of each of said first and second pluralities being spaced with respect to one another;

moving said first plurality of knives at a first linear speed in a first continuous path;

moving said second plurality of knives at a second linear speed, in the same direction as said first plurality of knives, in a second continuous path, said second linear speed being different than said first linear speed whereby said knives in sliding contact with one another advance with respect to one another;

cutting said funicular material between said knives in sliding contact with one another during said advancement of said knives.

26. A method for cutting funicular material into lengths of staple comprising the steps of:

rotating a first rotor and a second rotor, closely spaced from one another on a common axis, in the same direction with a first plurality of knives affixed to a surface of the first rotor facing a surface of the second rotor, a second plurality of knives being affixed to the surface of the second rotor;

feeding a continuous strand of tow between the first and the second rotors in a zigzag manner between the knives on the rotors at the periphery of the rotor;

contacting the first plurality of knives on the first rotor with the surface of the second rotor to cut the two into lengths of staple; and discharging the lengths of staple from between the rotors.

27. A method for cutting funicular material into lengths of staple comprising the steps of:

rotating a first rotor and a second rotor, closely spaced from one another, in the same direction with a first plurality of knives affixed to an axial end surface of the first rotor facing an axial end surface of the second rotor, the axes of the rotors being offset with respect to one another;

feeding a continuous strand of two between the first and the second rotors;

contacting the first plurality of knives on the first rotor with the surface of the second rotor to cut the two into lengths of staple;

discharging the lengths of staple from between the rotors; and adjusting the axial angular offset between the first rotor and the second rotor.

28. The method of claim 27 wherein the step of contacting the first plurality of knives on the first rotor with the surface of the second rotor includes the step or progressively advancing the first plurality of knives on the first rotor with respect to a second plurality of knives affixed to the surface of the second rotor, which second plurality includes at least one more knife than the first plurality of knives on the first rotor.

29. A method for cutting funicular material into lengths of staple comprising the steps of:

rotating a first rotor and a second rotor, closely spaced from one another on a common axis, in the same direction with a first plurality of knives affixed to a surface of the first rotor facing a surface of the second rotor;

feeding a continuous strand of tow between the first and the second rotors;

contacting the first plurality of knives on the first rotor with the surface of the second rotor to cut the two into lengths of staple while progressively advancing the first plurality of knives on the first rotor with respect to a second plurality of knives affixed to the surface of the second rotor, which second plurality includes at least one more knife than the first plurality of knives on the first rotor, so as to clamp the material between adjacent knives of the first and the second rotors after feeding the material to prevent escape of the material, to pull the clamped material around the periphery of the rotors and subsequently to cut the tow into segments; and discharging the lengths of staple from between the rotors.

30. A method for cutting funicular material into lengths of staple comprising the steps of:

rotating a first rotor and a second rotor, closely spaced from one another on a common axis, in the same direction with a first plurality of knives affixed to an axial end surface of the first rotor facing an axial end surface of the second rotor;

feeding a continuous strand of tow between the first and the second rotors;

contacting the first plurality of knives on the first rotor with the surface of the second rotor to cut the two into lengths of staple; and discharging the lengths of staple from between the rotors.

31. The method of claim 30 wherein the step of contacting the first plurality of knives on the first rotor with the surface of the second rotor includes the step of progressively advancing the first plurality of knives on the first rotor with respect to a second plurality of knives affixed to the surface of the second rotor, which second plurality includes at least one more knife than the first plurality of knives on the first rotor.

32. The method of claim 31 further comprising the step of:

rotating the first rotor slightly faster than the second rotor.

33. The method of claim 32 further comprising the step of:

continuously sliding each of the knives of one rotor over at least two knives on the other rotor whereby each of the knives is sharpened.

34. The method of claim 30 further comprising the step of:

admitting air to a radially inward portion of the first rotor and urging the air toward the periphery of the first rotor.

35. The method of claim 30 wherein the step of feeding the tow includes the step of:

feeding the tow between the rotors at the center of the rotors.

36. A method for cutting funicular material into lengths of staple comprising the steps of:

feeding said funicular material between a first surface of a first member and a second surface of a second member, said first and second surfaces each including a plurality of spaced knives, said funicular material being fed between said surfaces at a location where said knives are in substantial mis-mesh;

rotating said first and second surfaces in the same direction with said first surface rotating faster than said second surface, said pluralities of knives being in sliding contact with one another;

urging the funicular material radially outwardly during said rotation of said surfaces;

gripping said funicular material between adjacent knives of said first and said second surfaces; and subsequently cutting said funicular material into segments between said adjacent knives of said first and said second surfaces.

37. The method of claim 36 further comprising the steps of:

varying a length of said segments by varying a tension of said funicular material upon feeding, said varied tension urging said funicular material to be cut at a different radial distance of said first and said second surfaces.

* * * * *